US005813193A

United States Patent [19]

Chan et al.

[11] Patent Number: 5,813,193

[45] Date of Patent: Sep. 29, 1998

[54] METHOD AND APPARATUS FOR APPLYING CARRIERS TO CONTAINERS

[75] Inventors: John Chan, DeSoto, Tex.; Richard L. Chaddock, Huntington Beach, Calif.

[73] Assignee: Owens-Illinois Labels Inc., Toledo, Ohio

[21] Appl. No.: 823,674

[22] Filed: Mar. 24, 1997

[51] Int. Cl.[6] ..... B65B 27/04; B65B 61/14

[52] U.S. Cl. ..... 53/398; 53/441; 53/442; 53/48.4; 53/556

[58] Field of Search ..... 53/398, 427, 442, 53/441, 48.3, 48.4, 556, 582

[56] References Cited

U.S. PATENT DOCUMENTS

| | | | |
|---|---|---|---|
| 3,204,384 | 9/1965 | Dallas, Jr. | 53/427 |
| 3,462,909 | 8/1969 | Anderson . | |
| 3,766,702 | 10/1973 | Meissner et al. . | |
| 3,816,968 | 6/1974 | Morgan et al. | 53/48.4 |
| 4,018,027 | 4/1977 | Curry et al. | 53/48.4 X |
| 4,018,331 | 4/1977 | Klygis . | |
| 4,034,536 | 7/1977 | Mahaffy et al. | 53/427 X |
| 4,079,571 | 3/1978 | Schlueter et al. | 53/48.4 |
| 4,188,770 | 2/1980 | Tabur . | |
| 4,250,682 | 2/1981 | Braun | 53/48.4 |
| 4,281,502 | 8/1981 | Bonkowski | 53/48.3 X |
| 4,676,049 | 6/1987 | Wallter et al. . | |
| 5,088,269 | 2/1992 | Thelen | 53/398 |
| 5,671,588 | 9/1997 | Chan et al. | 53/48.4 X |

*Primary Examiner*—Horace M. Culver

[57] ABSTRACT

A method wherein a strip of flat plastic carriers having openings therein for application to groups of containers is moved from a source to a feed drum for delivering a strip of carriers to an applicator apparatus, a trough interposed between the source and the feed drum. Electrical heaters are provided beneath the trough. A strip of carriers is moved through the trough such as to heat the carriers from the underside thereof. The temperature of the heaters is controlled such that the strip of carriers is conditioned to compensate for ambient temperature.

5 Claims, 4 Drawing Sheets

METHOD AND APPARATUS FOR APPLYING CARRIERS TO CONTAINERS

This invention relates to a method and apparatus for applying plastic carriers on containers to form a carrier pack.

BACKGROUND OF THE INVENTION

In the application of apertured plastic carriers to containers to form a carrier pack, it is common to provide the plastic carriers in a continuous web. The web is normally provided in a roll and an unwinder apparatus delivers the web to the feed drum of an applicator apparatus. Typical patents showing such a construction is U.S. Pat. No. 3,816,968.

In such application of carriers, rolls of carriers are stored for usage. In cold climates, if these rolls of carriers are used, it is common that the carriers cannot be applied to groups of cans or bottles properly and the cans or bottles will drop out of the carrier. Thus, it has become the practice to store rolls of carriers in temperature controlled rooms for a period of 12 to 24 hours prior to use. Such a procedure requires additional handling of the rolls. Another effort used is to use heat lamps and heated forced air. Thus is an obstruction on the production floor. Another problem is that partial rolls left in the applicator apparatus upon shut down of operation must be replaced, requiring extra handling.

Among the objectives of the present invention are to provide a method and apparatus for heating the carriers which can be easily adapted to applicator apparatus; wherein the temperature of heating can be easily changed; which does not provide any obstruction on the production floor; which has no moving parts; which requires minimal maintenance; and which can have a production mode and a non-production mode.

In accordance with the invention, the method and apparatus which normally applies carriers to groups of containers from a strip or web of carriers on a roll to an applicator apparatus comprises interposing a heating assembly between the roll and applicator, directing the strip over the heater assembly and controlling the temperature of the apparatus. Preferably the heating apparatus comprises a heating trough mounted above the applicator apparatus. The heating trough preferably comprises flexible heaters associated with the trough.

DESCRIPTION OF THE PREFERRED EMBODIMENT

Figure 1:
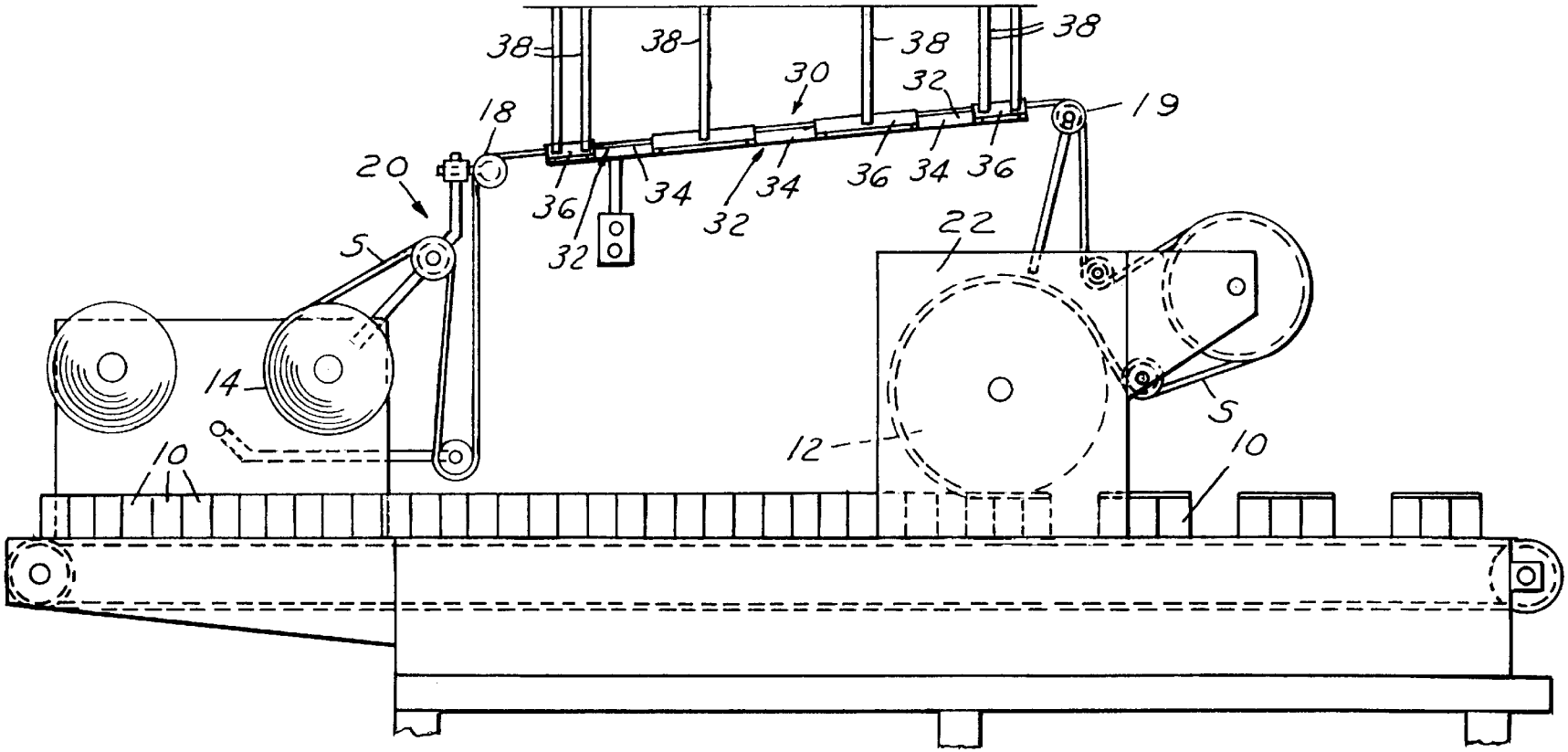
FIG. 1 is an elevational view of an applicator apparatus embodying the invention.
Figure 2:
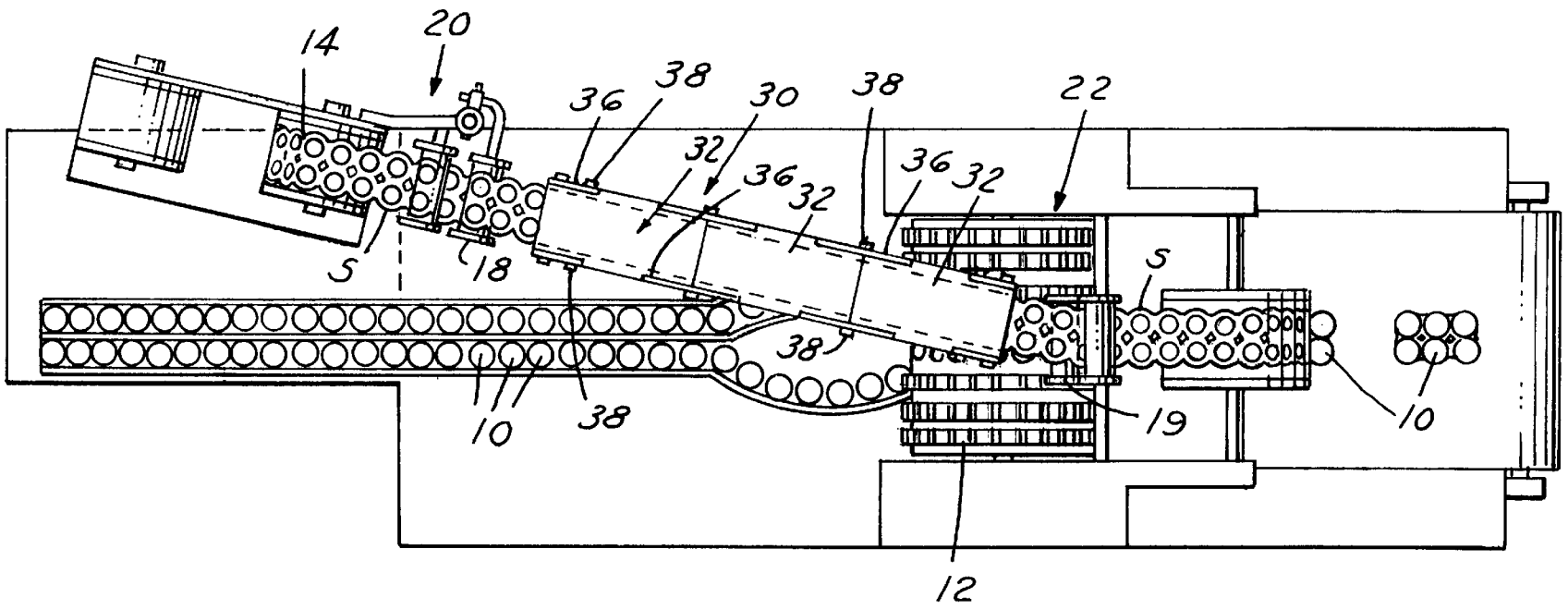
FIG. 2 is a plan view of the apparatus.
Figure 3:
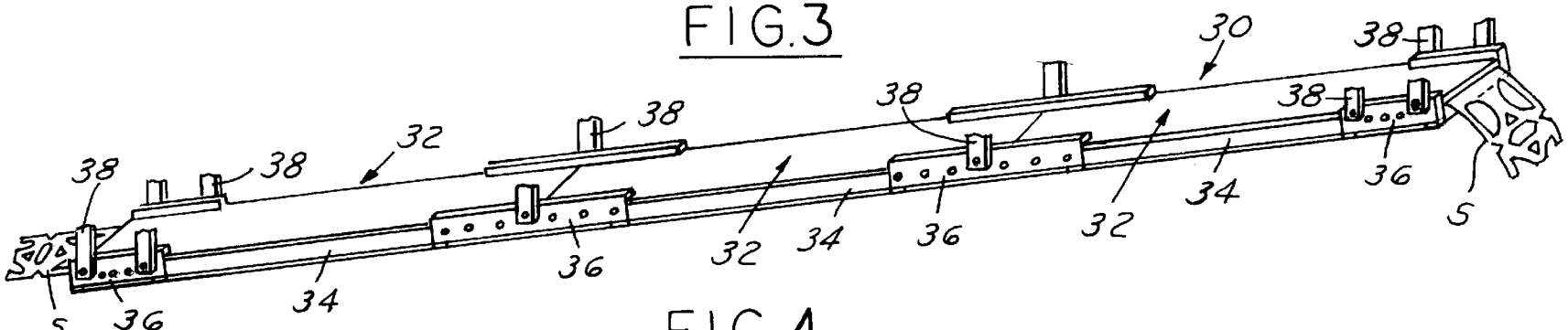
FIG. 3 is a fragmentary side perspective view of a portion of the apparatus.
Figure 4:
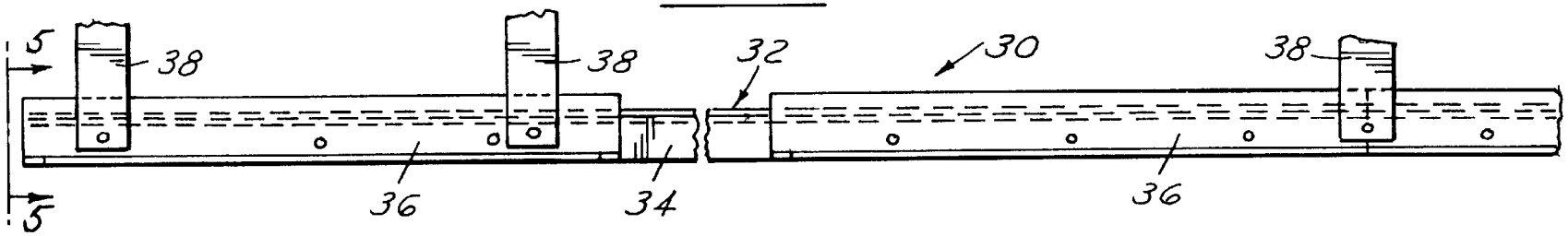
FIG. 4 is a fragmentary side view of the portion of the apparatus shown in FIG. 3.
Figure 5:
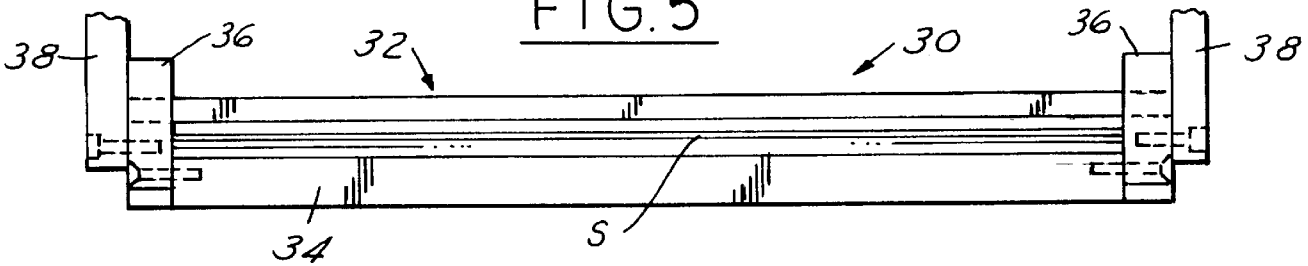
FIG. 5 is a fragmentary sectional view taken along the line 5—5 in FIG. 4.

Referring to FIG. 1, the present invention is directed to the heating of the strip or webs as the strip moves from an unwinder apparatus 20 to an applicator apparatus 22. In such an apparatus, containers 10 are supplied in rows by a conveyor, for example in two rows. The containers 10 are directed beneath the drum assembly 12 of the applicator apparatus. Carrier strip stock S comprising a strip of interconnected carriers is supplied from a reel 14 to the drum assembly 12 by rollers 18, 19. The carrier strip S is received by jaws on the drum assembly which stretch the strip and apply the carriers successively on the groups of containers. This apparatus may be of the type shown in U.S. Pat. No. 3,816,969 wherein the strip is gripped along its sides and stretched over the container, incorporated herein by reference.

In accordance with the invention, a heating apparatus 30 is provided between the unwinder apparatus 20 and the applicator apparatus 22. The strip S passes over the heating apparatus 30 which is preferably in the form of a heating trough. The heating trough is preferably formed by a plurality of heated sections 32. Each section 32 consists of flexible electric heaters 34. The sections are joined together by connector plates 36 and suspended above the applicator apparatus 22 by hangers 38.

Figure 6:
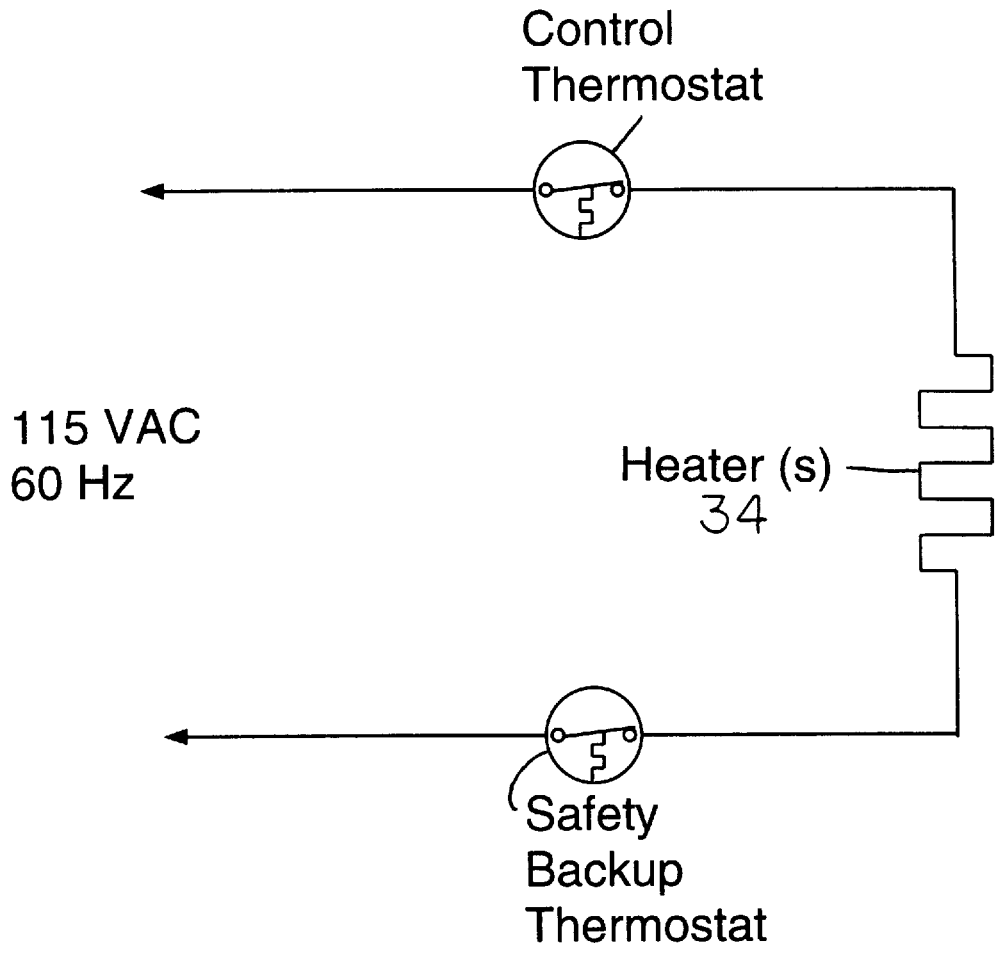
FIG. 6 is an electrical schematic diagram of the heater control circuit.

Referring to FIG. 6, provision is made for controlling the heaters 34 by an electric circuit as shown which includes a control thermostat and a safety back-up thermostat.

In operation, as the strip S is moved across the successive heaters, the temperature is raised to a predetermined optimum temperature for application to the cans.

It can thus be seen that there has been provided a method and apparatus for heating a strip of carriers moving from a supply to an applicator apparatus which can be easily adapted to applicator apparatus; wherein the temperature of heating can be easily changed; which does not provide any obstruction on the production floor; which has no moving parts; which requires minimal maintenance; and which can have a production mode and a non-production mode.

What is claimed is:

1. Apparatus for applying plastic carriers to groups of containers which comprises:

means for supplying carriers in a continuous strip of plastic, means for applying the carriers to groups of containers by elastically stretching each carrier until openings in the carrier are positioned over the containers and then releasing the carrier elastically to grip the containers, and means positioned between said supplying means and applying means for heating the entirety of said strip as said strip passes through said heating means to said applying means so as to enhance elasticity of said strip without softening or plastic deformation of said strip.

2. The apparatus set forth in claim 1 wherein said heating means comprises a heating trough over which said strip passes.

3. The apparatus set forth in claim 2 wherein said heating trough comprises successive electric heaters on said trough.

4. The apparatus set forth in claim 3 including means for controlling the temperatures of said heaters.

5. A method of applying plastic carriers to groups of containers that comprises the steps of:

(a) providing said carriers in a continuous strip of plastic, (b) directing said strip through a heater that heats the entirety of said strip as said strip passes through said heater, and then (c) applying each carrier to a group of containers by elastically stretching the carrier until openings in the carrier are positioned over the containers of the group, and then releasing the carrier elastically to grip the group of containers.

* * * * *